United States Patent [19]

Greene, Sr.

[11] 4,067,125

[45] Jan. 10, 1978

[54] RESILIENT FOOTWEAR HEEL

[76] Inventor: Hilliard Frank Greene, Sr., 400 E. Randolph St., Chicago, Ill. 60601

[21] Appl. No.: 774,856

[22] Filed: Mar. 7, 1977

[51] Int. Cl.[2] ..... A43B 21/26

[52] U.S. Cl. ..... 36/35 R; 12/146 R

[58] Field of Search ..... 36/35 R, 35 B, 28, 38; 12/146 R

[56] References Cited

U.S. PATENT DOCUMENTS

| | | | |
|---|---|---|---|
| 1,159,758 | 11/1915 | Gambino | 36/35 B X |
| 2,394,281 | 2/1946 | Williams | 36/38 |
| 2,532,742 | 12/1950 | Stoiner | 36/35 B |
| 3,172,136 | 3/1965 | Dardig | 12/146 R |
| 3,777,374 | 12/1973 | Hendricks | 36/38 |

*Primary Examiner*—Alfred R. Guest

*Attorney, Agent, or Firm*—Allegretti, Newitt, Witcoff & McAndrews

[57] ABSTRACT

A shoe heel made from a resilient material includes an interior cavity. Two magnetic plates of like polarity are embedded in opposed relationship within the interior cavity. The repulsive force between the magnetic plates cushions the act of walking and provides uniform support over the surface of the heel.

8 Claims, 3 Drawing Figures

Fig. 1
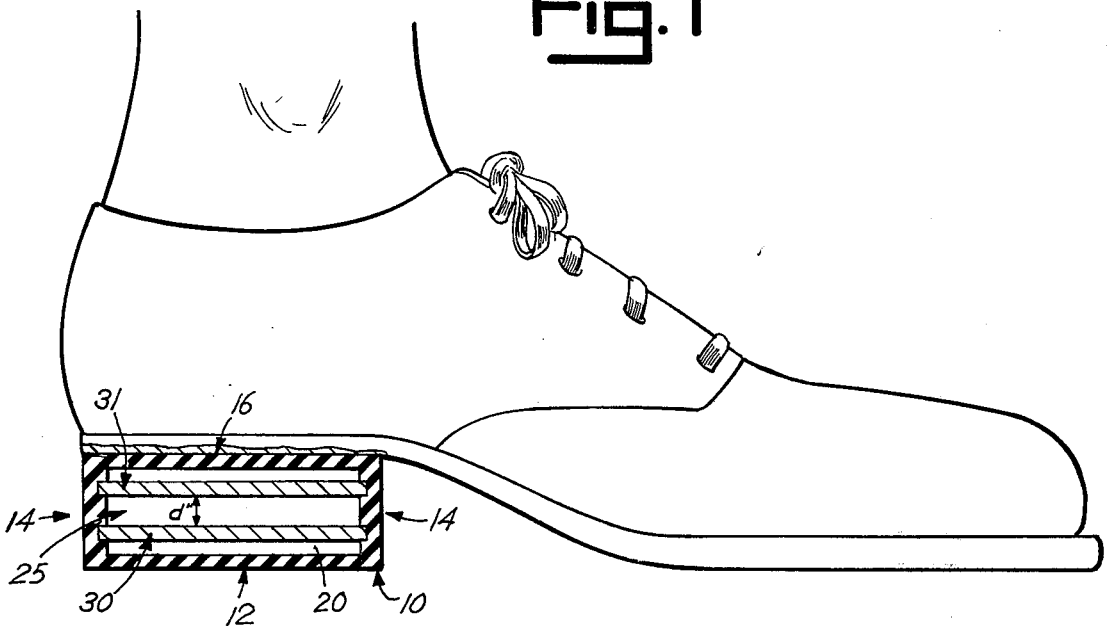
Fig. 2
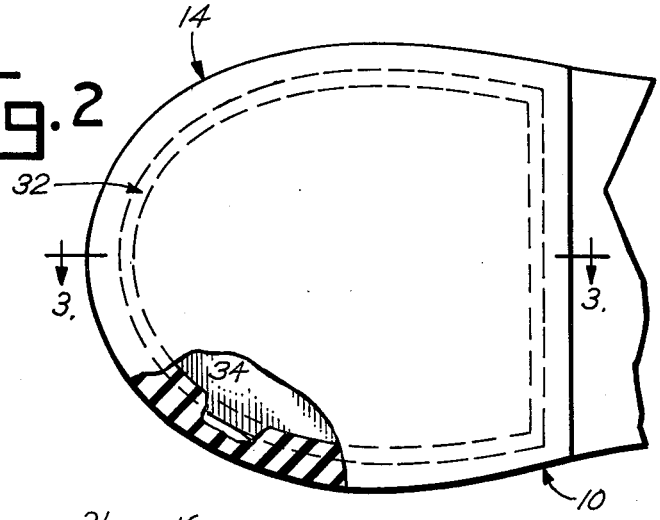
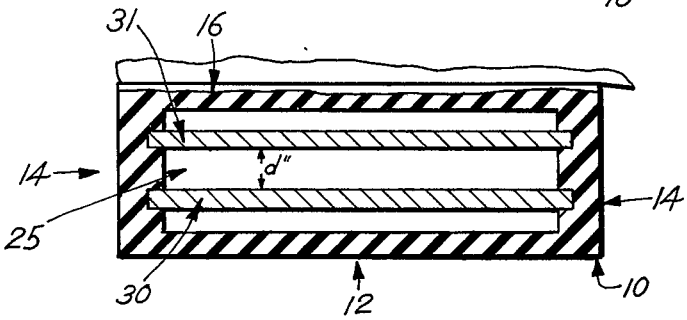
Fig. 3

RESILIENT FOOTWEAR HEEL

BACKGROUND OF THE INVENTION

This invention relates to an improved shoe heel device and more particularly to a heel device which effectively cushions the heel from the act of walking.

Walking and its associated motions involve subtle jolts and jars which are transmitted throughout the body by the skeletal structure. The heel of the foot at the end of an outstretched leg is generally the first part of the body to make contact with the ground during the act of walking. Since the heel in this position is relatively rigid, heel contact causes a jolt which is accentuated as the body is raised through the arc formed by movement of the body and leg over the heel during the act of walking. This jolt is transmitted directly up the legs, knees and hips to the spinal cord, neck, head and tissues in the trunk of the body.

A person is normally so accustomed to these jolts that they are not noticed. Although the jolts may seem slight, they may, over the years, cumulatively produce a destructive effect on body and facial tissues. The medical profession has recently undertaken to warn women, particularly, that walking and everyday movements will cause a sagging of breast tissues unless those tissues are properly supported. These same factors, walking and everyday movement, contribute along with the normal aging process to the sagging body tissues associated with old age.

The detrimental effects of the walking jolt primarily relate to sagging body tissue, but may also include pain to sensitive joints and aching in other parts of the body. A person who is having pain in the knees, back or head is acutely aware that walking in a manner which will soften this joint will also reduce the pain. Moreover, all people, regardless of age or sex, recognize that the "feel" of walking on a soft cushion is more desirable than the "feel" of walking on a hard surface.

It is known to cushion the walking jolt by making shoes, or footwear from suitably flexible material such as a rubber. More recently, it has been known to make heels which have a hollow interior and to place coil springs within the hollow interior. The purpose of this latter arrangement is to have the coil springs absorb the jolt of the heel making impact with the ground and impart a "cushiony" feel to the act of walking.

The prior products have certain deficiencies. For example, although rubber provides a softer heel than does leather, rubber alone does not produce a heel which is as "cushiony" as one might desire. Coil springs are expensive to buy, expensive to build into heels, and prone to fatigue. Furthermore, the springs may have a tendency to buckle and thereby distort the "feel" which one gets from a conventional heel. Springs also tend to support at certain points which become pressure points so that the support provided by the heel is not uniform over the surface of the heel. No prior product known to applicant comprises a heel which effectively cushions the walking jolt in a uniform manner and which can be inexpensively produced.

BRIEF SUMMARY OF THE INVENTION

In a principal aspect, the present invention comprises an improved, relatively inexpensive heel for use with footwear and which is capable of substantially absorbing a jolt to the wearer's body when the heel of the wearer's foot makes contact with the ground during the act of walking. The improved heel includes an outer casing having a generally heel shaped body. The outer casing has a lower, or walking surface, and an upper surface that may be secured to the heel area of footware. The outer casing has a generally hollow interior defined by the upper and lower surfaces and the side walls of the outer casing. Two plates made of highly ferromagnetic, permanently magnetized material are secured within the interior of the hollow cavity.

The magnetic plates are positioned within the hollow cavity so that the like poles are in opposed relation, thus creating a repulsive magnetic force between the two plates. If the magnetic plates are positioned parallel to one another, the direction of the magnetic force will be perpendicular to the plates. If the plates are not positioned parallel to one another, the direction of the magnetic force can be determined from well known principles of magnetism and geometry. The magnetic plates are separated a predetermined distance. The repulsive magnetic force is inversely related to the distance the plates are separated. The strength of the repulsive magnetic force is directly related to the resiliancy, or cushiony feel, of the heel.

The magnetic plates are secured within the outer casing in a manner which permits contraction or expansion of the distance separating them. In this way the magnets produce a spring-like, elastic action that diffuses the jolt produced by walking.

Accordingly, it is an object of this invention to create a resilient heel suitable for general use in footwear which is capable of substantially cushioning or diffusing over time, the jolt produced when the heel of a foot makes contact with the ground during the act of walking.

Another object of this invention is to provide a resilient heel which will provide substantially uniform support over the area of the heel.

One further object of this invention is to provide a less expensive design and method of producing the resilient heel as described.

Another object of this invention is to provide a resilient heel as described which will have a long lasting, useful life.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a cross-sectional view of the invention as actually used in combination with footwear.

FIG. 2 is a bottom plan view of the invention with a portion of the bottom and the side edge wall of the heel removed to expose part of a magnetized plate and to show how the magnetized plate is embedded in the material of the heel-shaped body.

FIG. 3 shows a cross-sectional view of the invention taken along the line 3—3 in FIG. 2.

DETAILED DESCRIPTION OF THE INVENTION

The invention relates to a resilient heel construction for footwear. The preferred embodiment of the heel construction, shown in FIGS. 1–3, has an outer casing 10 comprised of a bottom layer 12, a side wall 14, and an upper layer 16. The upper surface of the upper layer 16 of the outer casing directly abuts the footwear, as shown in FIGS. 1 and 3. The outer casing may be adhered to the footwear along the upper surface of the upper layer 16 by any conventional means such as an adhesion.

The outer casing 10 may be made from rubber, leather, neoprene, or any material commonly used to make heels. As best illustrated in FIG. 2, the casing 10 is formed as a shaped body which has an exterior appearance or shape similar to that of a substantially solid horseshoe although the appearance or shape could, of course, be similar to that of any of the heels that are commonly used on footwear, e.g. substantially a solid semi-circle, or U-shaped design.

The bottom layer 12 and the upper layer 16 have substantially the same shape as the outer casing 10. The side wall 14 is a single piece, relatively thin number which connects the upper and bottom solid layers along their peripheral edges. This side wall has an enclosed horseshoe, semi-circle or U-shaped appearance.

The upper and bottom layers 16 and 12, together with the side wall 14 of the outer casing 10 form and define a closed, hollow interior cavity 20. The cross-sectional area of cavity 20 is equal to that of either the bottom and upper layers less the cross-sectional area of the side wall 14.

Two plates 30 and 31 are embedded into the side wall 14 of the outer casing 10 within the interior cavity 20. The plates 30 and 31 are generally flat and may be made of any metal of highly ferromagnetic material which is capable of being permanently and highly magnetized. The plates 30 and 31 are disposed so that they are parallel, i.e. their planes are parallel, and are separated by a distance "*d*", as shown in FIG. 3. The plates 30 and 31 are magnetized with like magnetic poles of the plates in opposed relation, thereby creating a repulsive magnetic field within the interspacial area 25 between the plates.

Because of the disposition of the plates 30 and 31 with respect to each other, the lines of magnetic force are generally perpendicular to the planes of the plates 30 and 31. When a person is standing at rest in a normal position the lines of magnetic force will be perpendicular to the ground. Of course, when a person is walking and the heel is subjected to deformation forces, these lines of perpendicularity may vary.

Referring to FIG. 3, the bottom layer 12 of the outer casing 10 which is adapted to be brought into contact with the ground during normal usage, is substantially parallel to the plates 30 and 31 and should be of sufficient thickness and durability to withstand normal wear and tear over the normal life expectancy of a heel. The side wall 14 of the outer casing should be of sufficient thickness and durability to withstand normal wear and tear over the normal life expectancy of a heel. Similarly, the side wall 14 of the outer casing should be of sufficient thickness and durability to assist the magnetic force in supporting the weight over the heel while also providing a recess into which the plates 30 or 31 may be embedded. This side wall must also be sufficiently flexible or elastic to permit a spring like action of magnetic plates during movement of the wearer.

As noted above, the plates 30 and 31 may be secured to the outer casing 10 by embedding their peripheral portions into the side wall 14 to a predetermined depth 32, as shown in FIG. 2, and at a predetermined position within the heel. This depth 32 will vary depending upon the material used in making the outer casing 10 and the strength of the magnetic force. The side walls 14 should be sufficiently elastic to permit limited movement of the magnetic plates.

The required exposed surface area 34 for the plates 30 and 31, i.e. the area of the plates disposed within the cavity 20, in the preferred embodiment will vary with the style and size of the heel. The exact amount of surface area required to support the weight over the heel and impart resiliency or cushion to the act of walking will depend on the strength of magnetic field between the plates as well as the weight of the person wearing the shoe. The embedded portion of the plates 30 and 31 represented by depth 32 may or may not contribute to the support or resiliency of the heel depending, in large part, on the composition of the outer casing material, i.e. whether the material which makes up the outer casing will interfere with the magnetic forces. A presently preferred embodiment of the invention would have the exposed surface area of the plates 30 and 31 constitute approximately 80 to 85% of the entire area of the plate.

A first alternative manner (not shown) of securing the magnetic plates 30 and 31 within the outer casing 10 is to adhere or attach the top plate 31 directly to the upper surface 16 of the outer casing 10.

A second alternative manner (not shown) of securing the magnetic plates 30 and 31 within the outer casing 10 is to permit one or both plates to be free floating within the cavity 20. That is, the plates would have a shape and be of a size similar to that of the interior cavity 20 but would have a smaller area than that of the interior cavity. Under this second alternative, the plates 30 and 31 would still be repulsed from each other by the magnetic force and would be retained within the cavity 20 by the bottom and upper layers 12 and 16 of the outer casing 10, or, if no such upper and lower surface were desired, by clips or other retention means secured to the upper and lower edges of the side walls 14 of the outer casing 10.

It is to be understood that the embodiment of the invention which has been described is merely illustrative of one application of the principles of the invention. Numerous modifications may be made to the disclosed embodiment without departing from the true spirit and scope of the invention.

What is claimed is:

1. An improved resilient heel for use with footwear and the like, the improved resilient heel being capable of substantially absorbing the jolts to the wearer's body produced when the heel of wearer's foot makes contact with the ground during the act of walking, said heel comprising in combination:

an outer casing having a generally heel shaped body that has a first surface adapted to be secured to the heel of footwear and a second surface adapted to be brought into contact with the ground during the act of walking, said outer casing having a side wall and a hollow interior cavity defined by the first surface, the second surface and the side wall;

a first plate disposed within the hollow interior cavity in a first position, the first plate being made of a highly ferromagnetic material that has been permanently magnetized;

a second plate disposed within the hollow interior cavity in a second position spaced apart from the first plate, the second plate also being made of a ferromagnetic material that has been permanently magnetized;

the first and second plates being positioned within the hollow cavity so that the magnetic poles of the first and second plates create a repulsive magnetic force between the first and second plates; and means for elastically securing the first and second plates within the hollow interior cavity in their first and second positions, respectively.

2. The improved resilient heel as claimed in claim 1 wherein the first and second plates are generally flat; and wherein the first plate is substantially parallel to the second plate and to the second surface of the outer casing.

3. The improved resilient heel as claimed in claim 1 wherein said plates are separated by a predetermined distance.

4. The improved resilient heel as claimed in claim 1 wherein the lines of magnetic force are generally perpendicular to the second surface of the outer casing.

5. The improved resilient heel as claimed in claim 1 wherein the area of said plates which lies within said hollow interior cavity comprises an area equal to 80–85% of the surface area of said plates.

6. The improved resilient heel as claimed in claim 1 wherein said side walls of said outer casing is of sufficient thickness and durability to lend some support to the heel while also providing a surface into which the plates can be embedded.

7. The improved resilient heel as claimed in claim 1 wherein the periphery of said plates are embedded in said side walls to a depth which will firmly secure said plates in their predetermined positions within the hollow interior cavity.

8. An improved method of providing resilient, cushion-like support uniformly over the surface of a heel that is suitable for footwear and that has a bottom layer adapted to contact the ground during the act of walking, the improved method comprising the steps of:

a. forming an outer casing for said heel with a hollow interior cavity; and b. positioning two permanently magnetized plates made of a highly ferromagnetic material within the hollow interior cavity into the side wall of said outer casing so that said plates are positioned parallel to each other within the hollow interior cavity, so that said plates are spaced a predetermined distance from one another within the hollow interior cavity and so that the magnetic poles of said plates create a repulsive magnetic force between said plates, with the line of magnetic force being generally perpendicular to said bottom layer.

* * * * *